United States Patent [19]

Lutz

[11] 4,004,812

[45] Jan. 25, 1977

[54] DOMINO TYPE GAME

[76] Inventor: Paul H. Lutz, 8738 21st N. W., Seattle, Wash. 99817

[22] Filed: Apr. 17, 1975

[21] Appl. No.: 568,827

[52] U.S. Cl. ..... 273/137 C

[51] Int. Cl.[2] ..... A63F 9/20

[58] Field of Search ..... 273/137 R, 137 B, 137 C, 273/137 D, 152.7 R, 152 R; 35/31 G, 70, 71

[56] References Cited

UNITED STATES PATENTS

| | | | |
|---|---|---|---|
| 367,223 | 7/1887 | Moody | 35/31 G |
| 615,818 | 12/1898 | Dexter | 273/137 C |
| 2,782,039 | 2/1957 | Martin | 273/137 C |
| 2,824,740 | 2/1958 | Cowan | 273/137 D |
| 3,330,053 | 7/1967 | Hendrix | 273/137 C |
| 3,758,962 | 9/1973 | Bagdasar | 35/31 G |
| 3,785,655 | 1/1974 | Babb | 273/137 C |
| 3,830,502 | 8/1974 | Rodgers | 273/137 B |

FOREIGN PATENTS OR APPLICATIONS

| | | | |
|---|---|---|---|
| 5,539 | 4/1887 | United Kingdom | 273/137 D |
| 453,017 | 9/1936 | United Kingdom | 273/137 D |

*Primary Examiner*—Anton O. Oechsle
*Assistant Examiner*—Harry G. Strappello
*Attorney, Agent, or Firm*—Huebner & Worrel

[57] ABSTRACT

A domino type game consisting of two sets of rectangular playing pieces of substantially the same size and proportions, the first set consisting of a multiplicity of pieces of three different colors individual to the pieces having contiguous substantially square, coplanar opposite end surface areas; number symbols selected from a range of zero through nine disposed on said surface areas including a blank area symbolizing zero and spaced apart spot markings symbolizing selected numbers in said range, said set including pieces on which the number symbols on opposite end areas are different, known as "singles", and pieces on which the number symbols on the opposite end areas are the same, known as "doubles"; the second set consisting of a multiplicity of pieces of five different colors individual to the pieces and distinct from the first set, each piece having a rectangular surface area; and visual indicia on said surface areas of the second set individually symbolizing numbers selected from the range of one through nine with at least one additional piece symbolizing "Hi", at least one additional piece symbolizing Lo and at least one additional piece symbolizing both Hi and Lo, the various colors of the playing pieces having pre-assigned playing values.

13 Claims, 22 Drawing Figures

DOMINO TYPE GAME

BACKGROUND OF THE INVENTION

1. Field of the Invention

The present invention relates to a game of the domino type and more particularly to such a game having a multiplicity of playing pieces in two distinct sets, each set being of a plurality of different colors with the pieces of the different colors being of different playing values, the playing pieces of the first set having opposite ends bearing numerical symbols selected from the range of zero through nine and the second set bearing visually distinctive numerical symbols selected from the range of one through nine as well as pieces bearing visual indicia of "Hi", of "Lo", and of both Hi and Lo, the game being characterized by the playing of runs of the pieces of the second set in alternately high and low sequence in side by side transverse alignment as initiated from a piece of the first set and terminated by the playing of a piece on the run selected from specified pieces of both sets, the player terminating the run receiving credit for the playing values in the run subject to being deprived of such credit and it being given to any other player who plays the piece bearing both Hi and Lo on the closed run.

2. Description of the Prior Art

The game of the present invention is a domino type game which in certain respects is similar to dominoes but which affords far greater intellectual challenge, range and variety of playing opportunities, the potential for the development of greater skills and more effective entertainment and amusement.

Although the conventional game of dominoes has proved popular for many generations, the limitations thereof have been widely recognized and many games have been developed in an effort to provide greater challenge, opportunity and interest. For example, the games of the following U.S. patents have resulted from efforts by inventors spanning a period of approximately seventy years to improve upon the conventional domino game:

| Inventor | Patent No. | Date |
|---|---|---|
| Mandelbaum | 793,455 | June 27, 1905 |
| Strasburger | 1,345,277 | June 29, 1920 |
| Coble | 1,443,346 | Jan. 30, 1923 |
| Hardesty | 3,638,947 | Feb. 1, 1972 |
| Kerr | 3,680,866 | Aug. 1, 1972 |
| Kremer | 3,773,327 | Nov. 20, 1973 |
| Babb | 3,785,655 | Jan. 15, 1974 |
| Rodgers | 3,830,502 | Aug. 20, 1974 |

As will subsequently become more clearly apparent, the concepts, structures, and mode of playing of the games of these patents are vastly different from those of the present invention although they typify domino type games.

SUMMARY OF THE INVENTION

The broad object of the present invention is to provide an improved game for a plurality of players which is of increased intellectual challenge, conducive to intense competition, and productive of increased entertainment and amusement value.

Another object is to provide an improved game of the domino type.

Another object is to provide a domino type game in which the skills of analysis, understanding of probabilities, and the ability to plan in advance, and to adjust such plans as circumstances make desirable, are stimulated and improved.

Another object is to provide a game of the domino type in which the difficulty of playing the game is largely dependent upon the acumen of the competitors so that the game is of interest to a wide range of age groups and intellectual capacities.

Further objects and advantages will become apparent in the subsequent description in the Specification.

DESCRIPTION OF THE PREFERRED EMBODIMENT

Figure 1:
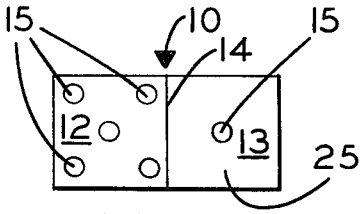
FIGS. 1 and 2 are plan views of characteristic pieces of a first set of playing pieces of the present invention.
Figure 2:
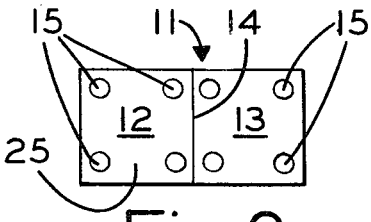
Figure 3:
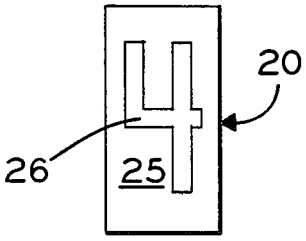
FIGS. 3 through 7 are plan views of characteristic playing pieces of a second set of the present invention.
Figure 4:
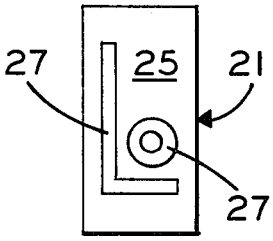
Figure 5:
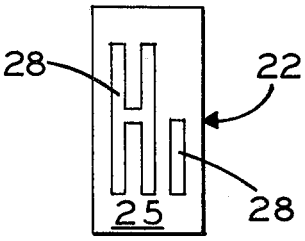
Figure 6:
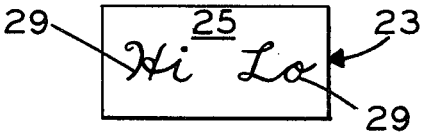
Figure 7:
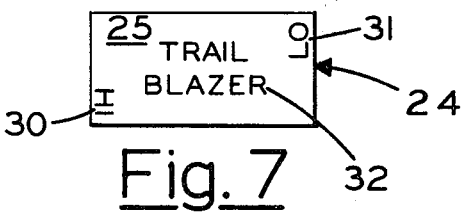

Referring in greater detail to the drawings, the first set of playing pieces of the present invention, as shown in FIGS. 1 and 2, are similar in form and shape to conventional dominoes but have distinguishing colors leading to greater versatility. For purposes of conveniences, the playing pieces of the second set shown in FIGS. 3 through 7 are sometimes hereinafter referred to as "nominoes". All of the playing pieces are of substantially the same size and shape being rectangular and twice as long as they are wide. They each have a face side bearing visual indicia and a classifying color and all except one of the nominoes, to which reference will subsequently be made, have back sides. The back sides are identical and indistinguishable.

As best seen in FIGS. 1 and 2, the dominoes are of two types, "singles" 10 and "doubles" 11. Both are divided into equal end areas 12 and 13 by a transverse central ridge 14, number symbols 15 selected from a range of 0 through 9 are disposed upon said equal areas including a blank surface, shown in FIGS. 19 through 22, symbolizing "0", and spaced apart spot markings symbolizing the selected numbers in said range. The number symbols 15 on the opposite end areas of the singles 10 are always different from each other while the number symbols on said opposite areas of the doubles 11 always match. The individual singles 10 are usually identified by reference to their number symbols reading from left to right. Thus, the single shown in FIG. 1 is known as a "five-one single". The doubles 11, of course, are individually identified by the number symbols common to both of their end areas. Thus, the double shown in FIG. 2 is known as a "four double".

Fifty-four dominoes 10 and 11 are employed in the game of the present invention. Such pieces are of three different colors. Nine are white, 37 black, and eight red. In order to avoid confusion, the dominoes shown in the drawings are not shaded to indicate color. The white dominoes are all doubles and cover the range of numbers of 1 through 9. The 37 blacks are all singles and they have the spot markings:

1/2, 1/3, 1/5, 1/6, 1/7 and 1/8
2/4, 2/5, 2/6, 2/7 and 2/9
3/4, 3/5, 3/6, 3/8 and 3/9

4/5, 4/7, 4/8 and 4/9
5/6, 5/7, 5/8 and 5/9
6/7 and 6/8
7/9
8/9
0/1, 0/2, 0/3, 0/4, 0/5, 0/6, 0/7, 0/8 and 0/9.

The eight red dominoes are also singles and carry the number symbols 1/4, 2/3, 1/9, 2/8, 3/7, 4/6, 6/9 and 7/8. The white dominoes have black spots and the black and red dominoes have white spots to symbolize their respective colors.

The five types of nominoes are best shown in FIGS. 3 through 7 represented at 20 through 24, respectively, each having an upper surface 25. The nominoes 20 of the form shown in FIG. 3 have visual indicia 26 symbolizing numbers selected from a range of zero through nine. Nominoes 21 have visual indicia 27 consisting of the letters "L" and "O" symbolizing "low". Nominoes 22 have visual indicia 28 bearing the letters Hi symbolizing "high". Only a single nomino 23 is provided which has visual indicia 29 on both sides. This nomino bears the indicia Hi Lo symbolizing both high and low. There is also only a single nomino 24 which has visual indicia 30 and 31 consisting of Hi and Lo, respectively, at opposite ends of the nomino, and further and dominant visual indicia 32 designating "Trail Blazer".

Forty-six nominoes 20 through 24 are employed, 15 being blue, 13 yellow, 11 green, six pink, and the single nomino 23 being white. The blue, yellow and green nominoes have black indicia and the pink nominoes have white indicia. The 15 blue nominoes contain symbols numbered 1 through 9, three designated Lo and three disignated Hi. The 13 yellow nominoes are numbered 1 through 9 with two being designated Lo and two being designated Hi. The 11 green nominoes bear the numbers 1 through 9 and include one designated Lo and one designated Hi. Of the pink nominoes, one is numbered 5, two labeled Lo, two labeled Hi, and one labeled "Trail Blazer".

OPERATION

In preparation for playing the game, the dominoes 10 and 11 and the nominoes 20 and 24 are placed face down in what is referred to as a "pool" or "boneyard" and shuffled. So disposed, none can be identified except for the nomino 23 which has identical opposite faces and is always conspicuous. The players then draw an equal number of the shuffled dominoes and nominoes except that the Hi Lo nomino 23 cannot be drawn at the start of the game. The number of pieces drawn by each player depends upon the number of players in the game. Usually at least 40 but less than 50 pieces are dealt from the pool. For example, if two players are involved each player is dealt 20 pieces; three players are each dealt 15 pieces; four players are each dealt 12 pieces; five players are each dealt nine pieces; and six players are each dealt seven pieces. Also, the number of pieces a player may draw in his turn in a round is dependent upon the number of players involved. If two or three players are involved, each may draw three pieces in his turn. If four, five, or six players are involved, each may draw two pieces in his turn.

The drawn pieces are placed on edge before each player with their playing faces hidden from view by other players. The player holding the highest double 11 leads by placing such double face up on a table or other playing area. If no player has a double, the pieces are all returned to the pool and re-shuffled whereupon the players again draw their required number.

The player who plays the first double is awarded the Hi Lo nomino 23 for subsequent use. He places it if front of himself for all to see.

Figure 8:
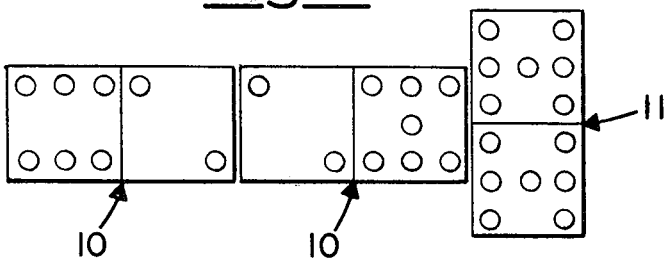
FIGS. 8 through 22 are various combinations of the playing pieces of the first and second sets typifying various playing capabilities and tactics which will subsequently be described.

As best shown in FIG. 8, the dominoes are played generally in accord with their normal utilization. A single 10 may be played on another single 10 in alignment therewith with the matching numerical symbols in juxtaposition. Thus, a 2/7 domino can be played on a 6/2 domino by juxtapositioning the areas bearing the two numerical symbols in alignment.

Figure 9:
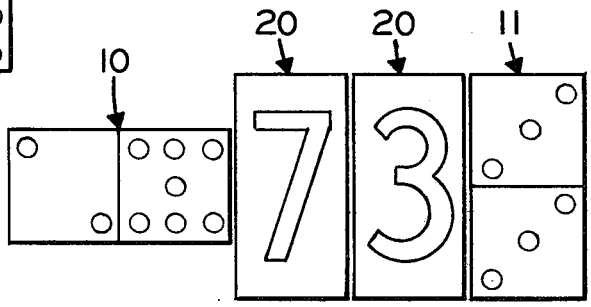

A double domino 11 can be played on a single domino 10 by placing the double domino in *a'* cheval relation to an end of a single domino bearing the same numerical symbol. The nominoes 20 through 24 are never played in longitudinal alignment with the dominoes or with each other. As shown in FIG. 9, a nomino 20 bearing a numerical visual indicia 26 can be played on a single domino 10 by positioning the nomino *a'* cheval on an end of a single domino having a matching numerical symbol. However, nominoes can be played on each other in side by side transversely aligned relation but are never played on other nominoes which they match. When a nomino is to be played on a preceding nomino which is greater than 5, the nomino to be played must be less than 5. Conversely, when a nomino is to be played on a preceding nomino which is less than 5, the nomino to be played must be greater than 5. In this regard, the Lo nominoes 21 are regarded as equivalent to nominoes 20 having numerals less than 5 and the Hi nominoes 22 as equivalent to nominoes 20 having numbers greater than 5.

Also, as shown in FIG. 9, a double domino 11 can be played on a preceding nomino of matching numerical designation by placing the same in side by side transverse alignment therewith.

One play has commenced, it proceeds from right to left other than for an exception to which reference will be made. Although the first player obtains possession of the Hi Lo nomino 23, he loses it to the next player playing a white double 11 unless he has played it before such next double is played. When the nomino 23 has been played, it nevertheless is awarded to the next player playing a white double.

It is to be remembered that all play and thus all trails, or sequence of pieces, begin off a white double 11. The first double may be played upon at each end and *a'* cheval on both sides. However, all subsequent doubles are placed *a'* chevel when added to another domino but along side when added to a nomino. In all cases the two ends of a double are open to further play while with the first double, and only the first double, the sides also are open for play.

Thus, after the first white double 11 has been played, the next player may play a single domino 10 in alignment or *a'* cheval relation thereto by matching an end of the single domino with the double domino.

While the dominoes in most instances can be played, joined to, or fitted to both dominoes and nominoes neither dominoes nor nominoes may be played on the nine black dominoes containing blanks on one of their end areas 12 or 13. Likewise, a blank cannot be played on a blank.

The red dominoes are exceptional in that whenever a red domino is played, the player immediately collects the value of the piece played which is determined by the sum of the spots on its face, five, ten or 15 points.

If a player plays a red domino on another red domino, he is credited the total playing value of both pieces. Similarly, if he plays a red domino on a succession of red dominoes, he is credited the total of their playing values.

The blue nominoes have a playing value of five points, the yellow nominoes ten points, and the green nominoes 15 points. The pink nominoes are wild and have the value of five, ten, or 15 points as they take on the value of the color of the piece on which they are played. The nominoes are usually played in the same attitude or position taken by the doubles, that is either *a'* cheval when added to a domino or along side of, when joined to a nomino.

The low blue, yellow, and green nominoes are regarded to be those bearing the numbers 1 through 4 and the high nominoes those bearing the numbers 6 through 9. The number 5 is neither low nor high and has a specialized function in terminating runs to which reference will be made. The nominoes 21 bearing the Lo indicia are playable in place of the numbered nominoes 1 through 4 and the Hi nominoes 22 playable in place of the nominoes 6 through 9. There are also four wild pink nominoes, two bearing Lo and two bearing Hi, which may be played in place of any low or high numbers respectively in any of the three colors of different values. There is also a wild pink 5 which may be played as a 5 on the blue, yellow and green nominoes. Other than the pink nominoes, the colored nominoes can only be played on nominoes of their same color. When any playing piece is played on another piece, it forms a trail. A trail may be made up of any properly played pieces and may extend indefinitely. However, a unique feature of the game of the present invention is the formation of "runs" providing additional intellectual challenge and opportunity for accelerated point acquisition. Whenever a numerical nomino 20 is played on a single 10 or double 11 domino of matching numerical symbol, as shown in FIGS. 9 through 17, or a Lo nomino 21 is played on a single or double domino 10 or 11 having a number less than 5, as shown in FIG. 18 or whenever a Hi nomino 22 is played on a domino having a numerical symbol of 6 through 9, a run is started. With the initiation of a run, all other moves are halted and all play occurs on the run until the run is closed. All plays on a run must alternately be of high and low value and all runs must be played in the color in which they are introduced except for the pink initiated runs which permit the player introducing the run simply to announce that the color of the run shall be considered to be blue, yellow, or green. As in initiating a run a Lo nomino 21 of the proper color can be used for any nomino 20 of a numerical value of less than 5 and any Hi nomino 22 of the proper color can be utilized for any numerical nomino 20 of a number greater than 5. FIGS. 9 through 18 illustrate the proper alternate sequential play during a run.

When it becomes a player's turn to play on a run and he has no nomino which can be played, he must draw from the pool of shuffled but undealt playing pieces. If he draws a playable nomino, he places it on the run and remains in the run. However, if after drawing he is still unable to play, he must pass from the run and lose his opportunities for participation therein. The play, however, continues with those who remain in the run and his turn is skipped until all but one player have passed from the run or the run is closed. They are not permitted to return to play as long as the run continues and two or more players remain in the run.

As a run is in progress, the players are required to play whatever nominoes they have that are proper to play. Since the nominoes bearing the number 5 are neither high nor low, they may be held by a player for subsequent use. Further, the pink high and low nominoes may also be held by a player for subsequent use as his judgment suggests.

Figure 11:
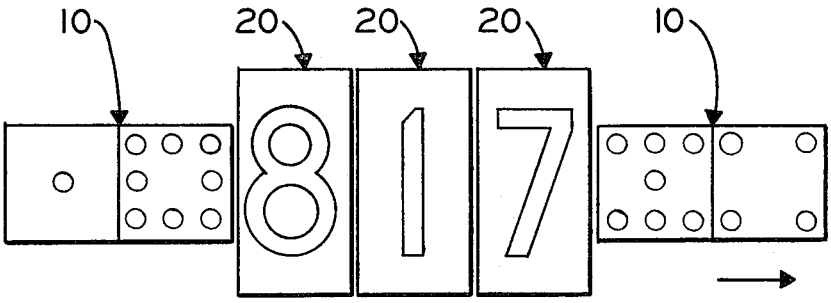
Figure 12:
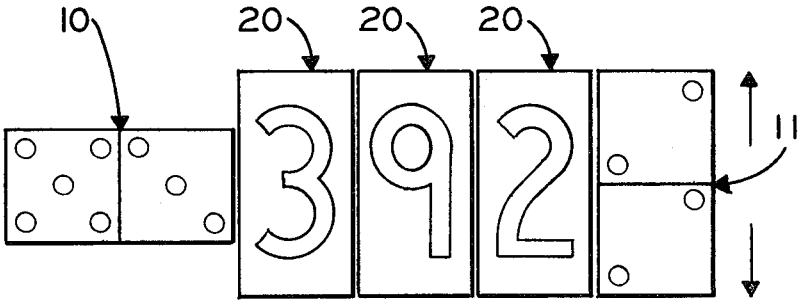
Figure 13:
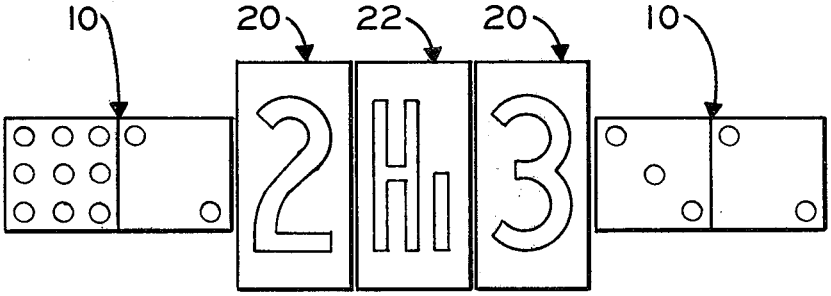

If as a run develops, all of the players except one are eliminated from the run, the remaining player must attempt to close it. He cannot delay closing to increase its value. He has only a single turn and that turn must be utilized to close the run. A run can be closed in any of several procedures with differing implications. Any black, red or white domino of matching numerical value may be used as shown in FIGS. 11, 12 or 16 or a run can be closed by playing any domino having a related numerical value as shown in FIGS. 13, 14, 15, and 17. Also, a 5 nomino 20 being of neither high nor low value can be played to close the run. A 5 nomino may in fact be used to close a run at any time during the run and while two and more players are still participating in the run. A 5 nomino may be used at the option of any player remaining in the run when it comes his turn to play.

The tactical decision as to how to close a run or, in some instances, when to close a run, is largely dependent upon the position of the Hi Lo nomino 23. It has no value in itself but has the power to steal all of the points accumulated in a run which is computed by multiplying the number of nominoes in the run by the piece value of the color involved. It will be recalled that the pink nominoes take on the value of the color on which they are played.

Figure 14:
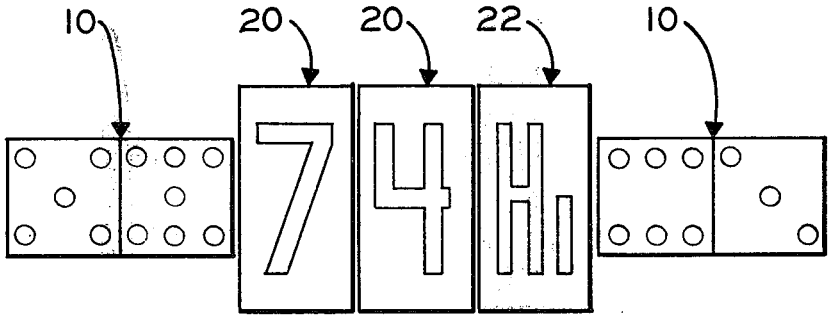
Figure 15:
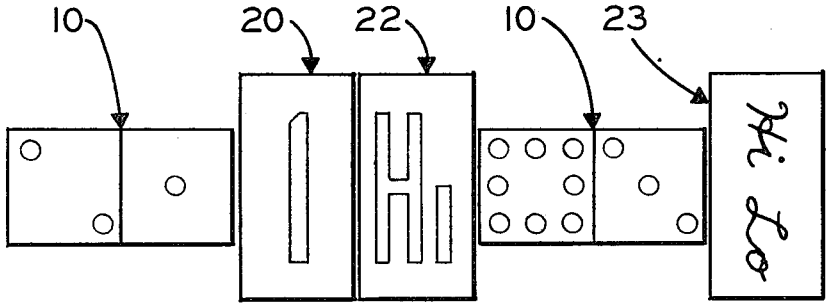
Figure 16:
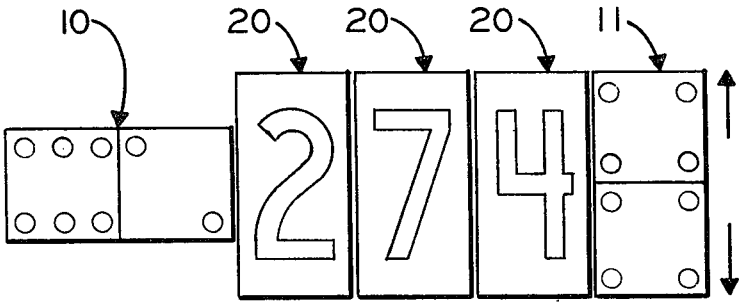

When a player closes a run with a related black or red domino as shown in FIGS. 14 and 15, the player who holds the white Hi Lo nomino 23 must immediately place it at the outer end of the black or red domino as shown in FIG. 15. The nomino 23 is then left on the field of play until it is again possessed by a player playing a double. The trail is closed until the nomino 23 is possessed by a player playing a double. When a player plays the Hi Lo nomino 23 on a black or red domino which closes a run, the player of the Hi Lo nomino takes all of the points with which the preceding player had been credited for closing the run. If it is a red domino on which the Hi Lo nomino is played, the Hi Lo nomino steals only the points accumulated in the run and not those of the red domino. The player who closed the run with a red domino receives the face value of such domino.

Figure 10:
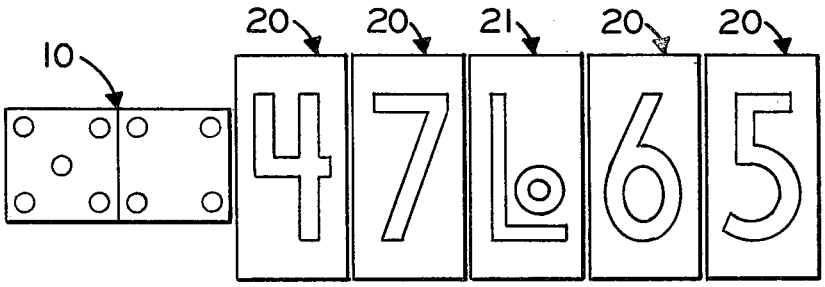
Figure 17:
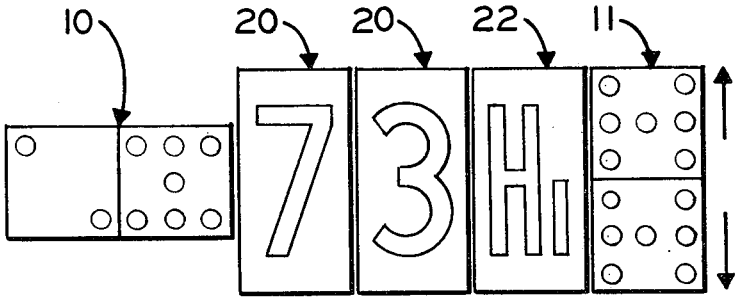
Figure 18:
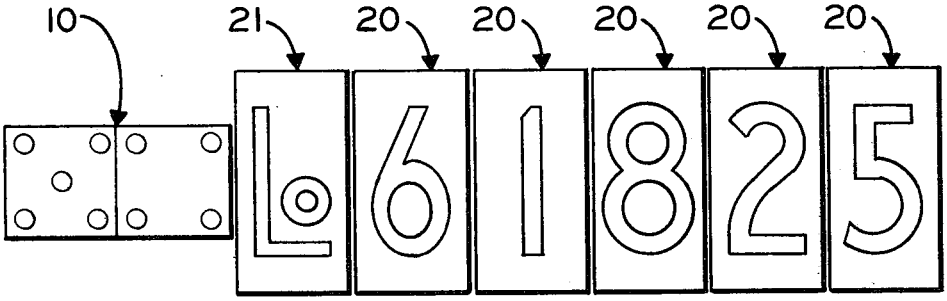

When a run is closed by a player playing a white domino in transverse alignment with a run in related relation to the preceding nomino, as shown in FIG. 17, or in matching relation to the numerical value of a preceding nomino, the playing of the white double will acquire possession of the Hi Lo domino 23 and thereby avoid its use to achieve a steal of the closed run. In such event, the player is credited with and keeps the accumulated value of the run and retains the Hi Lo nomino 23 for future use. Further, when a run is closed by playing a 5 nomino as shown in FIGS. 10 and 18, either in the color of the run or a wild 5 nomino, the Hi Lo nomino 23 cannot be played on it and the run is closed and the player who played the 5 nomino collects the accumulated value of the run including the 5 nomino which is counted with the other nominoes in the run.

It will be obvious that if the Hi Lo nomino 23 is not a threat to the person whose turn it is to close the run because he himself is in possession of it or it is involved in the field of play, he may prefer to close a run with a red or a black domino and retain the numbered 5 domino for a later opportunity for use.

If a player whose turn it is to close a run is unable to do so, he must draw from the pool of shuffled pieces and if he is still unable to play he must yield to the next player in turn. If this succeeding player has previously passed from the run, it nevertheless now becomes his turn to close it. If he cannot play a piece either from his hand or the shuffled pool, he must yield to the next player and the procedure continues until someone is able to close the run.

When a run has been closed, all trails that were halted during the run are reopened to play and play always resumes with the player to the left of the player who closed the run. This is true even when the run has been stolen. Since the play of the Hi Lo nomino 23 is made from outside and not within the player's hands, it is not counted as a turn and play resumes to the left of the person who closed the run.

When no player is able to close a run, it is declared a "dead trail" and may no longer be used. This is indicated by inverting the last tile of the run. Since the trail has not been closed no player may collect or steal its value but the points are lost to all players. All trails that are opened elsewhere on the field of play are then playable and play resumes to the left of the person who played the last tile in the run.

Figure 19:
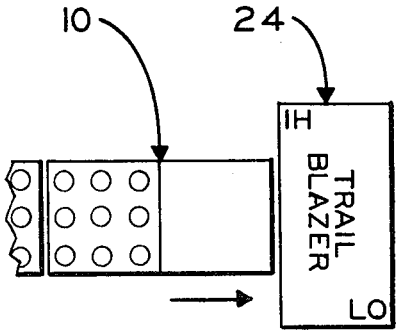
Figure 20:
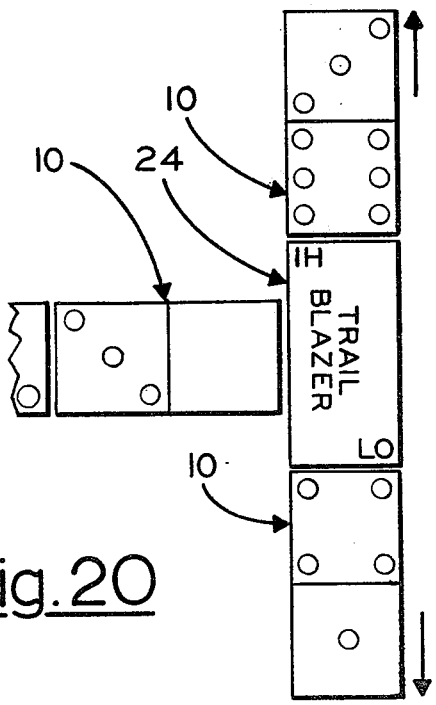

Provision is made to open a trail which has previously been closed. It will be recalled that a trail, as distinguished from a run, is closed by playing a black domino having a blank or zero end area on a trail. The pink Trail Blazer nomino 24 may be played *a'* cheval to the blank end of the closing domino as shown in FIG. 19. Single dominoes 10 may then be played on opposite ends of the Trail Blazer nomino 24 by playing the dominoes with ends having numerical values related to the Hi and Lo ends of the Trail Blazer nomino. Thus, a domino having a value greater than 5 can be played on the Hi end and a domino having a value less than 5 can be played on the Lo end, as shown in FIG. 20. When such dominoes are so played, they are played in longitudinal alignment with the Trail Blazer nomino.

Figure 21:
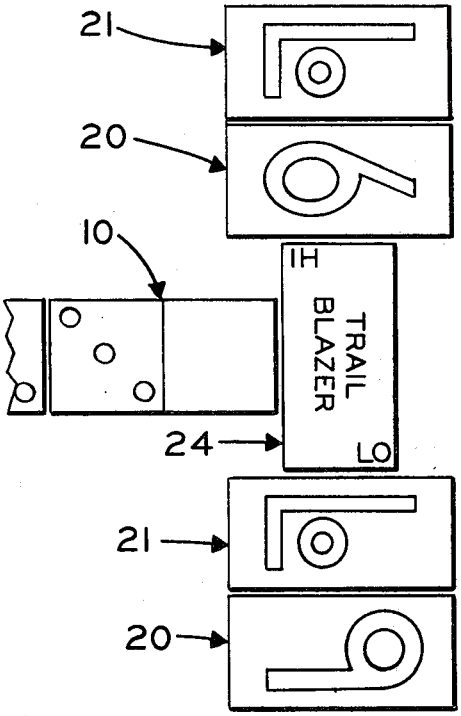
Figure 22:
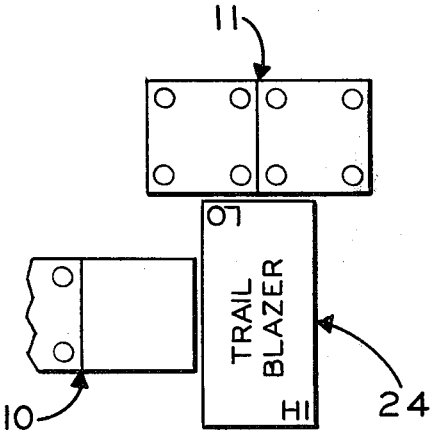

Alternatively, a nomino 20 having a numerical value higher than 5 can be played *a'* cheval on the Hi end of the Trail Blazer nomino or having a value of less than 5 on the Lo end thereof. Somewhat similarly, a nomino 21 can be played *a'* cheval on the Lo end of the Trail Blazer nomino or a nomino 22 played *a'* cheval on the Hi end thereof. As previously described, and as illustrated in FIG. 21, the successive nominoes are placed on the trail in transverse alignment and in alternately high and low sequence.

The Trail Blazer nomino 24 has a value of 15 points with which its owner is credited whenever it is played on a blank or zero domino to open a trail. If all trails are closed, the player who uses the Trail Blazer nomino to open a trail is awarded an additional 10 points from each of the other players, these points being subtracted from their respective scores and added to the player's previously accumulated points.

When all trails have been closed, the game is not thereby ended until it is determined whether any player has possession of the Trail Blazer nomino 24. If it is in the possession of one of the players, he may choose either to play or retain it. Since it is wild it is not compulsary to play it. Many times the possessor may find it to his advantage to have the deal remained blocked and thereby end the game. However, if the owner chooses to play the nomino 24, it can only be played on the blank or zero end portion of a black domino and is never played on a number 5 nomino to unlock a closed run nor on the white Hi Lo nomino 23.

Whenever the Trail Blazer nomino 24 is played, it opens two trails at opposite ends thereof. Play then continues to the left of the player who played the wild nomino. If another trail is open elsewhere on the field, it may also be used or a player may choose either of the two trails now open for play. If a player elects to play a Lo nomino 21 on the Lo end of the Trail Blazer nomino 24 or a Hi nomino on the Hi end of the Trail Blazer nomino, a run is initiated and play proceeds as described above.

A player who is able to play a piece in his hand whether a domino or a nomino must play it unless it is a pink nomino or a nomino bearing the number 5. If such a pink nomino or 5 nomino is involved, the player may choose not to play and prefer to draw. Further, when a player draws a piece that is playable from the accumulated shuffled pieces, he must play the piece and stop drawing. A player who chooses to draw rather than to play a numbered 5 or wild piece in his hand, may still select to play the piece after he has completed the draw and before he passes his turn to the next player.

At no time may the accumulated shuffled pieces be reduced to less than five pieces. When the accumulation is reduced to five pieces, a player who is unable to play must pass his turn.

There are three circumstances for drawing during play. They are when a run is not under way, during a run when a player is attempting to continue play and retain in the run, and at the conclusion of a run when a player is unable to make any of the available moves for closing the run. If a trail is obstructed by limitations on a playing area, or when a trail threatens to run into another trail or a player's hand, a played piece may be turned to an irregular position to avoid the limitation or obstruction.

Normally, a game lasts for three rounds and the player with the highest score at the end of three rounds is the winner. In addition to the scoring noted above, all nominoes held by each player at the close of a round excluding the Hi Lo nomino 23, are given a value of five points each and all dominoes a value of ten points. These points are totalled independently of each other. A player who ends a round by going out, that is, by playing his last domino, receives the total of all black, red, and white dominoes held by the other players. A player holding the Hi Lo nomino 23 is the recipient of the total nomino points held by the players. If a person who ends a round has possession of the Hi Lo nomino 23, he receives the total nomino points held by the players including those in his own hand, if any. When it occurs that the Hi Lo nomino 23 is not in the possession of any player, at the end of the round, the total nomino points are carried over into the next round of play. The total is recorded by a score keeper and the first person who plays a white double and claims possession of the Hi Lo nomino 23 gains the nomino points carried over from the previous round. When a round is halted because no player is able to make a move, it is a "blocked deal". In such event, the Hi Lo nomino 23 again determines the recipient of all nomino points either being awarded a player or carried over into the next round. Also, in the event of a blocked deal, the domino points remaining in a player's hand are substracted from his accumulated score as maintained by a score keeper.

When a player goes out to end a round, the maximum number of nominoes which he is permitted to hold in his hand while going out is determined by the number of players involved. When two players are playing, the player going out may hold six nominoes. For three players, he may hold five nominoes. For four players, he may hold four nominoes. For five players, he may hold three nominoes. For six players, he may hold two nominoes.

It occasionally happens that a player will end a round by going out while a run is in progress. Since the run has not been closed, the points accumulated in the run are lost to all players. Somewhat similar, a player will end a round and close a run in the same move. When this occurs, the Hi Lo nomino held by an opposing player must yet be played to steal the points accumulated in the run and is left unclaimed on the field, thereby effecting a carry over into the next round of the total nomino points held by all players.

The game may also be played by partners with two or three players composing a team. The rules are substantially the same except that points gained or lost by an individual belong to a team and the Hi Lo nomino 23 is viewed as the property of the team and cannot be used to steal points from a partner but only used to steal from opposing players. When a player ends a round by going out while his partner holds the Hi Lo nomino 23, the team receives the total of both the dominoes and nominoes then held in the hands of all players.

The game of the present invention may be played with intellectual challenge by young and old, skilled and unskilled. It constitutes a domino type game having vastly amplified opportunities for long range tactical planning and execution. In concept, structure, and play, it has added a wide range of competitive challenge to the well-known game of dominoes.

Although the invention has been herein shown and described in what is conceived to be the most practical and preferred embodiment, it is recognized that departures may be made therefrom within the scope of the invention.

Having described my invention, what I claim as new and desire to secure by Letters Patent is:

1. In a game, a multiplicity of substantially rectangular playing pieces, a plurality having numerical symbols visually represented thereon selected from a defined numerical range having a mid point, another piece symbolizing Hi and still another piece symbolizing Lo, said pieces being adapted to be successively positioned in side by side relation in transverse alignment in a run of alternate numerically higher and lower sequence with the piece symbolizing Lo being equivalent to pieces lower than said mid point and the piece symbolizing Hi being equivalent to pieces higher than said mid point, said pieces being of different colors and having a pre-assigned playing value individual to their respective colors.

2. A game comprising first and second sets of substantially rectangular playing pieces of equal size, the first set consisting of 54 pieces each having a playing surface divided into substantially square opposite end areas and nine thereof being of a first color, 37 being of a second color and eight being of a third color; number symbols selected from a range of zero through nine disposed upon said equal areas on the pieces of the first set including a blank surface symbolizing zero and the number symbols being spaced apart spot markings symbolizing selected numbers in said range; the second set consisting of 46 pieces each having a rectangular playing surface, 15 pieces being of a fourth color, 13 of a fifth color, 11 of a sixth color, six of a seventh color and one of the first color; and visual indicia on the playing surfaces of some of the pieces of the second set of pieces individually symbolizing numbers selected from a range of one through nine on the pieces of the fourth, fifth and sixth colors, the visual indicia on three of the fourth color, two of the fifth color, one of the sixth color and two of the seventh color symbolizing Lo, the visual indicia on three of the fourth color, two of the fifth color, one of the sixth color and two of the seventh color symbolizing Hi, the visual indicia on one of the seventh color symbolizing the digit five, on one of the seventh color symbolizing Trail Blazer and on the piece of the first color of the second set symbolizing Hi Lo.

3. A domino type game comprising two sets of rectangular playing pieces of substantially the same size and proportions, the first set consisting of a multiplicity of pieces of three different colors individual to the pieces having contiguous substantially square, coplanar opposite end surface areas; number symbols selected from a range of zero through nine disposed on said surface areas including a blank area symbolizing zero and the number symbols being spaced apart spot markings symbolizing selected numbers in said range, said set including pieces on which the number symbols on opposite end areas are different, known as singles, and pieces on which the number symbols on the opposite end areas are the same, know as doubles; the second set consisting of a multiplicity of pieces of five different colors individual to the pieces and distinct from the first set, each piece having a rectangular surface area; and visual indicia on said surface areas of the second set individually symbolizing numbers selected from the range of one through nine with at least one additional piece symbolizing Hi, at least one additional piece symbolizing Lo and at least one additional piece symbolizing both Hi and Lo, the various colors of the playing pieces having pre-assigned playing values, the pieces of the first set being playable on each other by matching numerical symbols with the signals in longitudinal alignment and the doubles in *a'* cheval relation to the preceding pieces; the pieces of the second set having visual indicia symbolizing numbers being playable in *a'* cheval relation on pieces of the first set by matching numerical symbols therewith, that symbolizing Lo being playable in *a'* cheval relation on pieces of the first set having numerical symbols lower than five, that symbolizing Hi being playable in *a'* cheval relation on pieces of the first set having numerical symbols higher than five all to start a run; the pieces of the second set being playable during a run on other pieces of the second set of the same color in alternate high and low sequence in side by side transverse alignment with the pieces having numerical symbols smaller than five being regarded as low and the pieces having numerical symbols larger than five being regarded as high; the pieces of the second set bearing the numerical symbol five being playable on any preceding piece in a run in side by side transverse alignment to stop a run; the singles of the first set of at least one predetermined color being playable on the last piece of a run having visual indicia corresponding thereto in end to side relation therewith and the doubles of the first set of said color being playable on the last piece of a run having visual indicia corresponding thereto in side by side transverse alignment to stop a run, the player stopping a run being credited with the aggregate value of the pieces in the run; and the piece of the second set bearing the Hi Lo symbol being playable on the piece of the first set of said predetermined color which has stopped a run to deprive the player stopping the run of said aggregate value of the pieces of the run and award them to the player of said piece of the second set.

4. The game of claim 3 in which the pieces of the second set of one of the colors are playable on any other color and take on the playing value of the piece played upon.

5. The game of claim 3 in which a sequence of plays forming a trail is terminated by playing a piece of the first set thereon having an extended end having a blank area symbolizing zero.

6. The game of claim 5 in which one of the pieces of said one color is visually distinctive and is playable on said extended end to permit subsequent playing thereon to extend the trail.

7. A domino type game comprising first and second visually distinguished sets of substantially rectangular playing pieces of one set bearing at their opposite ends individual number symbols selected from a defined numerical range and pieces of the other set individually bearing digital symbols from substantially the same numerical range as the number symbols, said numerical range including groups of numbers distinguishable as to group in both sets by their relative numerical values, and additional pieces in one of said groups bearing indicia individual thereto designating said respective groups of pieces in the other set.

8. A game comprising first and second sets of substantially rectangular playing pieces, the pieces of the first set each having a substantially rectangular playing surface divided into opposite end areas and pieces of the second set having undivided substantially rectangular playing surfaces, the end areas of the first set of pieces individually bearing number symbols selected from a defined numerical range and the playing surface of some of the pieces of the second set individually bearing digital symbols from substantially the same numerical range as the number symbols, said numerical range including groups of numbers distinguishable as to group in both sets by their relative numerical values, and other of the pieces of the second set bearing indicia individual thereto designating said respective groups of pieces of the first set.

9. The game of claim 8 in which the pieces are of different colors and have pre-assigned playing value individual to their respective color.

10. The game of claim 8 in which the groups are distinguishable by their respective numerical value by being higher or lower than a predetermined number, and said other pieces of the second set have indicia individual thereto which designate the groups of the first set in terms of being higher or lower than said predetermined number.

11. A game comprising first and second sets of substantially rectangular playing pieces of substantially equal size, the pieces of the first set each having a playing surface divided into substantially square opposite end areas; number symbols selected from a predetermined range of sequential numbers disposed individually on said areas of the pieces of the first set; the pieces of the second set having rectangular playing surfaces; visual indicia on the playing surface of some of the pieces of the second set of pieces individually symbolizing numbers selected from said range; visual indicia on the playing surfaces of other pieces of the second set of pieces symbolizng a group of numbers of higher numerical value in said range; and visual indicia on the playing surface of still other pieces of the second set of pieces symbolizing a group of numbers of lower numerical value in said range.

12. The game of claim 11 including in said second set of pieces a piece bearing on its playing surface visual indicia of a numerical value substantially mid-way of said range, in which the group of numbers of said higher numerical value are higher than the mid-way visual indicia, and in which the group of numbers of said lower numerical value are lower than the mid-way visual indicia.

13. The game of claim 12 including in said second set of pieces a piece bearing on its playing surface visual indicia symbolizing both the group of numbers of higher numerical value and the group of numbers of lower numerical value.

* * * * *

UNITED STATES PATENT AND TRADEMARK OFFICE

CERTIFICATE OF CORRECTION

PATENT NO. : 4,004,812

DATED : January 25, 1977

INVENTOR(S) : Paul H. Lutz

It is certified that error appears in the above-identified patent and that said Letters Patent are hereby corrected as shown below:

Column 3, Line 18, delete "O" and insert ---o---.

Column 4, Line 16, sentence beginning "The nominoes 20" should be beginning of new paragraph.

Column 12, Line 12, delete "respective" and insert ---relative---.

Signed and Sealed this

Fifth Day of April 1977

[SEAL]

*Attest:*

RUTH C. MASON
*Attesting Officer*

C. MARSHALL DANN
*Commissioner of Patents and Trademarks*